US006609782B2

(12) United States Patent
Mori

(10) Patent No.: US 6,609,782 B2
(45) Date of Patent: Aug. 26, 2003

(54) LIQUID JET RECORDING HEAD AND METHOD OF MANUFACTURING THE SAME

(75) Inventor: Toshihiro Mori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,031

(22) Filed: Jul. 9, 2001

(65) Prior Publication Data

US 2002/0003556 A1 Jan. 10, 2002

(30) Foreign Application Priority Data

Jul. 10, 2000 (JP) ..... 2000-209095

(51) Int. Cl.[7] ..... B41J 2/01
(52) U.S. Cl. ..... 347/50
(58) Field of Search ..... 347/50, 58, 63, 347/71, 87

(56) References Cited

U.S. PATENT DOCUMENTS

| | | | | |
|---|---|---|---|---|
| 5,442,386 A | * | 8/1995 | Childers et al. | 347/50 |
| 5,491,505 A | | 2/1996 | Suzuki et al. | 347/203 |
| 6,241,340 B1 | * | 6/2001 | Watanabe et al. | 347/50 |
| 6,257,703 B1 | * | 7/2001 | Hirosawa et al. | 347/50 |
| 6,335,750 B2 | * | 1/2002 | Horiuchi et al. | 347/200 |
| 6,471,901 B1 | * | 10/2002 | Kawamura et al. | 264/267 |

FOREIGN PATENT DOCUMENTS

EP 0 593 175 A 4/1994

EP 0 822 078 A 2/1998

OTHER PUBLICATIONS

N. Irving Sax and Richard J. Lewis, Sr., *Hawley's Condensed Chemical Dictionary*, 11$^{th}$ ed. (New York: Von Nostrand Reinhold Co.), pp. 114, 461, 467, 944, 945, 948, 1004, 1039 and 1040 (XP002122301), 1987.

* cited by examiner

*Primary Examiner*—Michael Nghiem
(74) *Attorney, Agent, or Firm*—Fitzpatrick, Cella, Harper & Scinto

(57) ABSTRACT

A liquid jet recording head has a recording element unit that has a recording element substrate, a flexible film member electrically connected to the substrate, a support member on which the substrate is fixedly held, and a support plate between the flexible film member and support member fixedly holding the flexible film member. A first thermosetting resin agent, which retains elasticity even after being hardened, is filled into recesses around the recording element substrate within an opening of the flexible film member and an opening of the support plate, and electrical connection areas between the substrate and the flexible film member are coated by a second thermosetting resin agent, which has a higher mechanical strength after being hardened than that of the first resin agent. The substrate is protected from damage due to shrinkage of the resin agent, and the electrical connection area between the substrate and the flexible film member can be protected against external forces.

21 Claims, 13 Drawing Sheets

LIQUID JET RECORDING HEAD AND METHOD OF MANUFACTURING THE SAME

BACKGROUND OF THE INVENTION

1. Field of the Invention

The present invention relates to a liquid jet recording head for ejecting a recording liquid in the form of droplets through minute ejection orifices, thereby recording an image on a recording medium, and a method of manufacturing the liquid jet recording head.

2. Description of the Related Art

A liquid jet recording apparatus is one of the so-called non-impact type recording apparatuses, and has the features that it is capable of recording an image on various types of recording media at a high speed, and hardly generates noise during the recording. Because of those features, the liquid jet recording apparatus has been widely employed as a recording mechanism in printers, word processors, facsimiles, copying machines, etc.

As a typical example of liquid jet recording techniques for use in that type of liquid jet recording apparatus, there is known one using an electrothermal transducer as an ejection energy generating element. According to this technique, droplets of a recording liquid are ejected through minute ejection orifices to record an image on a recording medium. A liquid jet recording apparatus employing such a technique comprises, generally, a recording head including ejection nozzles to form droplets, and a recording liquid supply system for supplying a recording liquid to the recording head. A liquid jet recording head using electrothermal transducers is constructed such that the electrothermal transducers are arranged in a pressurized chamber, an electrical pulse representing a recording signal is applied to each of the electrothermal transducers for giving thermal energy to a recording liquid, and droplets of the recording liquid are ejected by utilizing bubble pressure resulting from bubbling (boiling) of the recording liquid, which is produced as a result of a phase change of the recording liquid caused upon application of the thermal energy.

Furthermore, the liquid jet recording head using electrothermal transducers is divided into two types, i.e., one (edge shooter type) wherein the recording liquid is ejected parallel to the board on which the electrothermal transducers are arranged, and the other (side shooter type) wherein the recording liquid is ejected perpendicular to the board on which the electrothermal transducers are arranged.

FIG. 11 (consisting actually of FIGS. 11A, 11B and 11C) shows a conventional typical board (referred to as a "recording element substrate" hereinafter) on which electrothermal transducers are arranged and which has the function of ejecting a recording liquid. Specifically, FIG. 11A is a plan view, FIG. 11B is a bottom view, and FIG. 11C is a side view. FIG. 12 shows the recording element substrate of FIG. 11 connected to a wiring board.

As shown in FIGS. 11A to 11C, a recording element substrate 101 has a through hole (recording liquid supply port) 103 formed therein for supply of a recording liquid from the rear surface side of the board 101. A plurality of electrothermal transducers (not shown) for applying ejection energy to the recording liquid are arranged on the surface of a substrate 102 on both sides of the through hole 103. Further, an ejection plate 105 is disposed on the substrate 102, and a plurality of ejection orifices 106 are formed in the ejection plate 105 opposite to the plurality of electrothermal transducers in a one-to-one relation. A plurality of electrodes 107 are provided on the surface of the substrate 102 at both ends thereof for electrical connection to the plurality of electrothermal transducers.

Also, as shown in FIG. 12, a recording element unit 120 is constructed such that the plurality of electrodes 107 provided on the recording element substrate 101 and a plurality of electrode leads 113 provided on a flexible film member 111 are electrically connected to each other by the TAB technique, for example. These electrical connection areas are each entirely coated by a sealing resin 119 for protection against corrosion caused by the recording liquid and breakage of wires due to externally acting forces.

FIG. 13 is an external appearance perspective view showing one structural example of a conventional liquid jet recording head in which the recording element unit of FIG. 12 is incorporated.

European Patent Application Laid-Open Publication No. EP0822078A2 shows a liquid jet recording head which is one example of the conventional liquid jet recording head, shown in FIG. 13, in which the recording element unit of FIG. 12 is incorporated. FIG. 14 is a partial enlarged sectional view, taken along line A—A in FIG. 13, of the liquid jet recording head of that Publication.

In the liquid jet recording head disclosed in that Publication, as shown in FIGS. 13 and 14, the recording element unit is fixedly bonded to an upper surface of a support member 108 by a bonding resin A 121. Further, a support plate 109 is fixedly bonded to the upper surface of the support member 108 by a bonding resin B 122, and the flexible film member 111 is fixedly bonded to an upper surface of the support plate 109 by a bonding resin C 123. Also, a second wiring board 116 is held on and fixed to a lateral surface of the support member 108, and an external input pad 115 for applying an electrical signal, such as recording information, to the liquid jet recording head from the body side of a recording apparatus is provided on the second wiring board 116. The second wiring board 116 is electrically connected to a plurality of recording element units through flexible film members 111*a*, 111*b*, 111*c* and 111*d*.

Thus, in the liquid jet recording head of European Patent Application Laid-Open Publication No. EP0822078A2, the recording element substrate and the wiring board are electrically connected to each other by leads, and a second sealing resin is applied to an electrical connection area between both the boards. Then, the recording element substrate is fixedly joined to the support member, the wiring board is fixedly bonded to the support plate, and a first sealing resin is filled into a recess formed between the support plate and the recording element substrate. Stated otherwise, since the first sealing resin is filled into the recess formed between the support plate and the recording element substrate in a state where the second sealing resin has been applied to the electrical connection area between the recording element substrate and the wiring board, a hollow space often occurs below the electrical connection area. In such a case, the recording liquid may enter the hollow space and corrode wires formed on the flexible film member 111.

In view of the above problem, U.S. patent application Ser. No. 09/488,931 proposes a method of employing a thermosetting material as the first sealing resin, and very reliably filling the first sealing resin, under heating, into a space below the electrical connection area to which the second sealing resin has been applied. This invention utilizes the property of the thermosetting material that it has a higher fluidity in an initial state of the heating and is then hardened.

Also, in a liquid jet recording head disclosed in that U.S. patent application, materials having substantially the same components are used as the first sealing resin filled into the space around the recording element substrate 101 and the second sealing resin sealing the electrical connection area between the recording element substrate 101 and the wiring board 111. The first sealing resin and the second sealing resin are heated and hardened in the same step. Because the material selected for sealing the electrical connection area between the recording element substrate 101 and the wiring board 111 is required to become very hard after hardening, for protection against external forces, a material containing an epoxy resin as a main ingredient is used for both the first and second sealing resins.

SUMMARY OF THE INVENTION

However, the recording element substrate 101 is vulnerable to external forces acting perpendicularly to the longitudinal direction (length) of the recording liquid supply port 103, from the structural point of view. Accordingly, if the sealing resin having the above-mentioned properties is filled in the recess formed beside the recording element substrate 101 on the side opposite to where the electrical connection is formed between the recording element substrate 101 and the wiring board 111, there occurs a risk that the recording element substrate 101 may be cracked and damaged by forces imposed during shrinkage of the sealing resin during hardening. Therefore, the sealing resin can be filled in sufficient amount into one of the recesses formed around the recording element substrate 101 which is positioned on the side locating below the electrical connection area between the recording element substrate 101 and the wiring board 111 (i.e., on the side perpendicular to the longitudinal direction of the recording liquid supply port 103). As shown in FIG. 15, however, into a recess 117 formed laterally of the recording element substrate 101 on the side parallel to the longitudinal direction of the recording liquid supply port 103, the sealing resin can be applied just to such an extent that the sealing resin coats the lateral surfaces of the recording element substrate 101 and the support plate 109 for protection against corrosion due to the recording liquid and short-circuiting through the recording liquid. In other words, a sufficient amount of sealing resin cannot be filled in the recess 117, unlike the liquid jet recording head shown in the above-cited EP Publication. When the amount of sealing resin filled in the recess 117 is insufficient, there may occur the following problem. The recording liquid scattered during printing or wiping of the head for cleaning, is gradually accumulated in the recesses formed on both sides of the recording element substrate, and remains there, with increased viscosity. Then, the recording liquid having the increased viscosity adheres to a wiper during the wiping of the head. Further, if the recording liquid having the increased viscosity adheres to the ejection orifices, a trouble may occur in the process for stably ejecting droplets of the recording liquid.

Moreover, in the conventional liquid jet recording heads described above, the flexible film member has a narrower width than the support plate and is bonded to the upper surface of the support plate inward of its outer periphery. Therefore, if a bonding resin for joining the flexible film member and the support plate to each other spreads out of the flexible film member when applied, the spread-out bonding resin adheres to a heater used for joining the flexible film member to the support plate by heat-pressing and then hardens. In such an event, production of defective heads continues until hardening of the bonding resin on the heater is discovered. Then, the production line must remain stopped until the replacement of the existing heater and the adjustment of a new heater are completed.

The present invention has been accomplished with the view of overcoming the above-mentioned problems in the related art, taking into account that materials of sealing resins should have different suitable properties depending on areas to be sealed by the sealing resins. It is an object of the present invention to provide a liquid jet recording head and a method of manufacturing the head, in which a sufficient amount of sealing resin can be filled into a space below an electrical connection area between a recording element substrate and a flexible film member; the recording element substrate is not damaged upon a shrinkage of the sealing resin during hardening even when the sealing resin is applied in an amount sufficient to fully fill recesses formed around the recording element substrate; and the electrical connection area between the recording element substrate and the flexible film member can be protected against external forces that occur upon, e.g., wiping of the head.

Another object of the present invention is to provide a liquid jet recording head and a method of manufacturing the head, with which efficient production can be realized by simultaneously carrying out steps of hardening (curing) a plurality of sealing resins made of different materials.

Still another object of the present invention is to provide a liquid jet recording head and a method of manufacturing the head, which can prevent deterioration of printing quality caused when a sealing resin for protecting an outer periphery of the flexible film member against the recording liquid is brought into contact with a recording medium.

Still another object of the present invention is to provide a liquid jet recording head and a method of manufacturing the head, which can eliminate the causes of inviting failures in the bonding step and can realize stable production.

To achieve the above objects, the present invention provides a liquid jet recording head comprising at least one recording element unit comprising a recording element substrate including a plurality of recording elements for ejecting a recording liquid, and a flexible film member having an opening in which the recording element substrate is assembled, and electrically connected to the recording element substrate for applying electrical energy to the recording element substrate for ejection of the recording liquid, the flexible film member including a plurality of electrode leads which are provided along edges of the opening of the flexible film member and are electrically connected to a plurality of electrode pads provided along edges of the recording element substrate; a support member on which the recording element substrate is fixedly held; and a support plate having an opening into which the recording element substrate is inserted, situated between the flexible film member of the recording element unit and the support member, and fixedly holding the flexible film member. A first thermosetting resin agent having elasticity even after being hardened is filled into recesses formed around the recording element substrate within the opening of the flexible film member and the opening of the support plate, and electrical connection areas between the recording element substrate and the flexible film member are coated by a second thermosetting resin agent, which has a higher mechanical strength after being hardened than that of the first resin agent.

With the thus-constructed liquid jet recording head of the present invention, since the first sealing resin fills in the recesses which are formed around the recording element substrate within the opening of the flexible film member and the opening of the support plate, and has elasticity even after being hardened, there is no risk that the recording element substrate may suffer from cracks or other damages upon a shrinkage of the first resin agent during the hardening. Further, since the electrical connection areas between the recording element substrate and the flexible film member are coated by the second resin agent having a higher mechanical strength after being hardened than that of the first resin agent, those electrical connection areas can be protected against external forces that occur during, e.g., wiping of the head.

The first resin agent may be a thermosetting silicone-modified epoxy resin, and the second resin agent may be a thermosetting epoxy resin.

An outer periphery of the flexible film member may be sealed by a sealing agent. This feature is effective to prevent corrosion of the outer periphery of the flexible film member due to the recording liquid.

Preferably, the flexible film member is formed so as to completely cover an upper surface of the support plate and to extend out of an outer peripheral edge of the support plate. With this feature, the sealing resin can be applied to a rear surface (side facing the support member) of a portion of the flexible film member, which is extended out of the outer peripheral edge of the support plate. It is therefore possible to not only prevent the resin agent from adhering to a heater for joining the flexible film member to the support plate by thermal pressing, but also prevent the resin agent from spreading out to the surface side of the flexible film member and deteriorating printing quality due to contact of the spread-out resin agent with a recording medium.

In that case, more preferably, the sealing agent is applied along a surface of the portion of the flexible film member, which is extended out of the outer peripheral edge of the support plate, the surface facing the support member, and along an outer peripheral surface of the support plate.

When the first resin agent and the sealing agent are made of the same material, the first resin agent and the sealing agent can be applied in the same step and hardened at the same time.

The first resin agent and the sealing agent may be made of a thermosetting silicone-modified epoxy resin.

Also, the present invention provides a method of manufacturing a liquid jet recording head comprising at least one recording element unit comprising a recording element substrate including a plurality of recording elements for ejecting a recording liquid, and a flexible film member having an opening in which the recording element substrate is assembled, and electrically connected to the recording element substrate for applying electrical energy to the recording element substrate for ejection of the recording liquid, the flexible film member including a plurality of electrode leads which are provided along edges of the opening of the flexible film member and are electrically connected to a plurality of electrode pads provided along edges of the recording element substrate; a support member on which the recording element substrate is fixedly held; and a support plate having an opening into which the recording element substrate is inserted, situated between the flexible film member of the recording element unit and the support member, and fixedly holding the flexible film member. A first thermosetting resin agent having elasticity even after being hardened is filled into recesses formed around the recording element substrate within the opening of the flexible film member and the opening of the support plate, and electrical connection areas between the recording element substrate and the flexible film member are coated by a second thermosetting resin agent, which has a higher mechanical strength after being hardened than that of the first resin agent. The method comprises joining the support plate to a predetermined position on the support member; joining the recording element substrate of the recording element unit to a predetermined position on the support member through the opening of the support plate, and joining the flexible film member onto the support plate; electrically connecting the plurality of electrode leads of the flexible film member respectively to the plurality of electrode pads of the recording element substrate; filling the first resin agent into the recesses; coating the electrical connection areas by the second thermosetting resin agent which has a higher mechanical strength after being hardened than that of the first resin agent; and heating the first resin agent and the second resin agent after the step of filling the first resin agent into the recesses and the step of coating the electrical connection areas by the second resin agent.

With the method of manufacturing a liquid jet recording head according to the present invention, it is possible to manufacture a recording head which is free from a risk that the recording element substrate may suffer from cracks or other damages upon a shrinkage of the first resin agent during the hardening, and in which the electrical connection areas between the recording element substrate and the flexible film member can be protected against external forces that occur during, e.g., wiping of the head.

Further, since the first resin agent and the second resin agent can be hardened at the same time under heating, production efficiency can be improved in comparison with the case of carrying out the steps of curing the first resin agent and the second resin agent successively.

The first resin agent may be filled into the recesses after the step of coating the electrical connection areas by the second resin agent. With this feature, even when the first resin agent is poured from both outer peripheral sides of the recording element substrate parallel to a recording liquid supply port, air residing below the electrode leads can escape through gaps between the electrode leads, thereby enabling the first resin agent to flow to all corners of the recesses. As a result, the first resin agent can be applied so as to fill the overall recesses without leaving hollow spaces below the electrode leads.

Conversely, the electrical connection areas may be coated by the second resin agent after the step of filling the first resin agent into the recesses. In this case, by pouring the first resin agent from one outer peripheral side of the recording element substrate parallel to the recording liquid supply port, the first resin agent is caused to flow to all corners of the recesses, whereby the first resin agent can be applied so as to fill the overall recesses without leaving hollow spaces below the electrode leads.

The step of electrically connecting the plurality of electrode leads of the flexible film member respectively to the plurality of electrode pads of the recording element substrate may be performed by gang bonding for connecting all of connection points at a time.

Alternatively, the step of electrically connecting the plurality of electrode leads of the flexible film member respectively to the plurality of electrode pads of the recording element substrate may be performed by single-point bonding for connecting connection points one by one successively.

Alternatively, the step of electrically connecting the plurality of electrode leads of the flexible film member respectively to the plurality of electrode pads of the recording element substrate may be performed by wire bonding for connecting connection points one by one successively.

Alternatively, the step of electrically connecting the plurality of electrode leads of the flexible film member respectively to the plurality of electrode pads of the recording element substrate may be performed by an ACF connecting method.

When the flexible film member in the liquid jet recording head is formed so as to completely cover an upper surface of the support plate and to extend beyond an outer peripheral edge of the support plate and an outer periphery of the flexible film member is sealed by a sealing agent, the method of manufacturing the liquid jet recording head may comprise: joining the support plate to a predetermined position on the support member; joining the recording element substrate of the recording element unit to a predetermined position on the support member through the opening of the support plate, and joining the flexible film member onto the support plate such that the flexible film member completely covers the upper surface of the support plate and its outer peripheral edge extends beyond the outer peripheral edge of the support plate; electrically connecting the plurality of electrode leads of the flexible film member respectively to the plurality of electrode pads of the recording element substrate; and applying the sealing agent to the outer periphery of the flexible film member.

With the above method of manufacturing a liquid jet recording head according to the present invention, it is possible to manufacture a recording head which can not only prevent the resin agent from adhering to a heater for joining the flexible film member to the support plate by thermal pressing, but also prevent the resin agent from spreading out to the surface side of the flexible film member and deteriorating printing quality due to contact of the spread-out resin agent with a recording medium.

Preferably, the step of applying a sealing agent to an outer periphery of the flexible film member comprises the step of supplying the sealing agent to only one point of the outer periphery of the flexible film member so that the sealing agent flows to the entire outer periphery of the flexible film member due to capillary forces acting in a region surrounded by a surface of a portion of the flexible film member, which extends beyond the outer peripheral edge of the support plate, the surface facing the support member, an outer peripheral surface of the support plate, and a surface of the support member facing the flexible film member.

Also preferably, the method of manufacturing a liquid jet recording head further comprises: filling the first resin agent into the recesses formed around the recording element substrate within the opening of the flexible film member and the opening of the support plate; coating the electrical connection areas between the recording element substrate and the flexible film member by the second resin agent; and heating the sealing agent, the first resin agent and the second resin agent after the steps of filling, coating and applying.

Further objects, features and advantages of the present invention will become apparent from the following description of the preferred embodiments with reference to the attached drawings.

DESCRIPTION OF THE PREFERRED EMBODIMENTS

A preferred embodiment of the present invention will be described below with reference to the drawings.

Figure 1A:
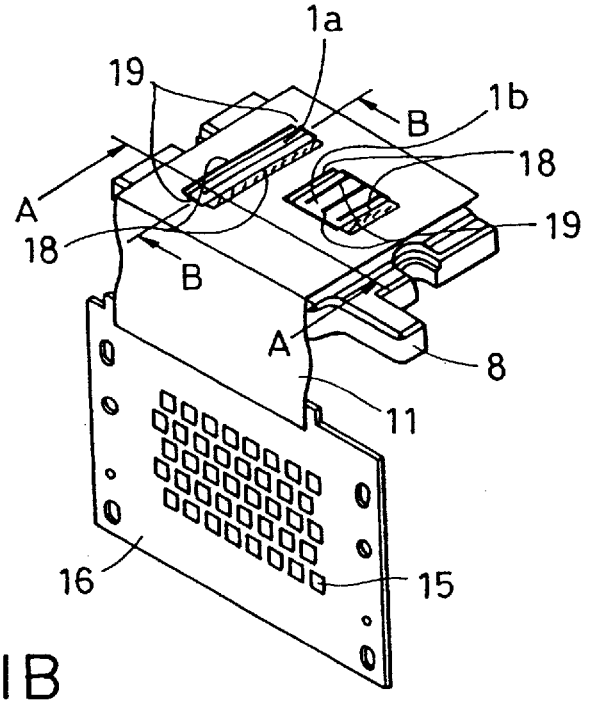
FIGS. 1A, 1B and 1C show a recording element unit used in one embodiment of a liquid jet recording head of the present invention.
Figure 1B:
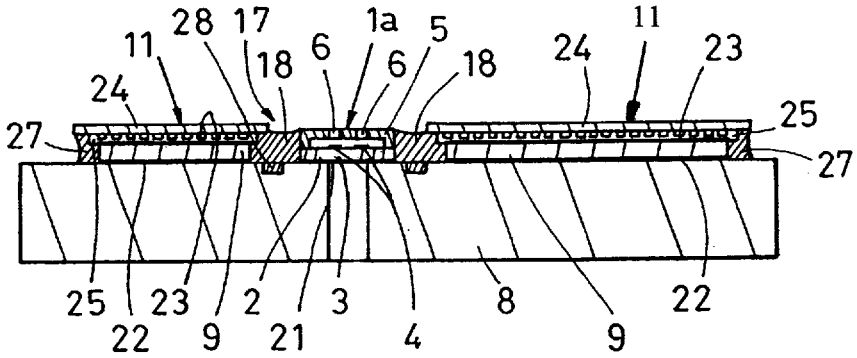
Figure 1C:
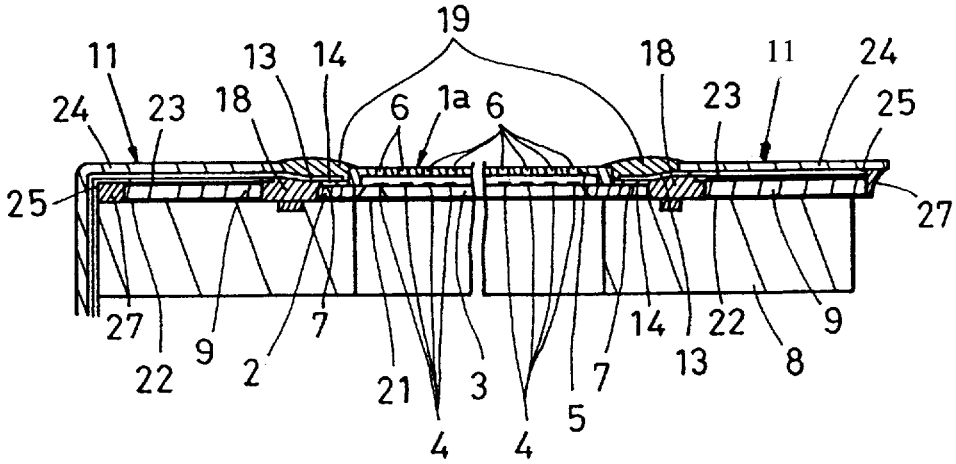

FIGS. 1A, 1B and 1C show a recording element unit constituting a part of one embodiment of a liquid jet recording head of the present invention. FIG. 1A is a perspective view of the recording element unit, FIG. 1B is a sectional view taken along line A—A in FIG. 1A, and FIG. 1C is a sectional view taken along line B—B in FIG. 1A.

As shown in FIG. 1A, the recording element unit used in the liquid jet recording head of the present invention comprises a plurality of recording element substrates 1*a*, 1*b* (two in the embodiment for the sake of illustration) having different shapes and sizes from each other; a support member 8 on which the recording element substrates 1*a*, 1*b* are fixedly held; a flexible film member 11; and a support plate 9 disposed between the support member 8 and the flexible film member 11 and fixedly holding the flexible film member 11.

An ejection orifice plate 5 is provided on the surface side of each recording element substrate 1*a*, 1*b*, and a plurality of ejection orifices 6 for ejecting a recording liquid are formed through the ejection orifice plate 5 in two rows at positions opposite ejection energy generating elements (e.g., electrothermal transducers) 4 that serve as recording elements. At the center of each recording element substrate 1*a*, 1*b* on the rear side (the underside, in these Figs.), a recording liquid supply port 3 is provided for supply of the recording liquid over substantially the same length as the array of the ejection orifices 6 in a longitudinal direction thereof (that is, where as in the illustrated arrangement, the orifices 6 are in rows that form a rectangular array, the supply port 3 has a shape, as seen from the front—from above, in FIG. 1B—is roughly or exactly rectangular).

Also, as shown in FIG. 1C, at both ends of each recording element substrate 1*a*, 1*b*, a plurality of electrodes 7 are provided and electrically connected to the ejection energy generating elements 4 in a one-to-one relation. As generally practiced, stud bumps 14 made of gold wires are provided respectively on the electrodes 7. While stud bumps are employed in this embodiment, the bump structure is not limited to the illustrated one. A similar effect can also be obtained by using solder bumps or plated bumps. Each recording element substrate 1*a*, 1*b* is disposed such that its rear surface is adjacent to an upper surface of the support member 8 serving as a recording liquid supply member, and is fixedly bonded at a predetermined position with a high accuracy, on the order of several $\mu$m to several tens of $\mu$m. Note that only several ejection orifices 6 and electrodes 7 are shown in FIGS. 1B and 1C for illustrative purpose, but they are in fact provided in number ranging from several tens to several hundreds.

As will be seen from FIG. 1A, the flexible film member 11 has two openings in which the two recording element substrates 1*a*, 1*b* are assembled respectively in an exposed state. (One of the two openings in the flexible film member 11 is shown as the gap between the two portions of the flexible film member 11 shown in FIGS. 1B and 1C.) For electrical connection of the recording element substrates 1*a*, 1*b*, electrode leads 13 to be electrically connected to the electrodes 7 of each recording element substrate 1 are provided at edges of the openings in the same number as the electrodes 7. The electrode leads 13 are electrically connected to the electrodes 7 of the recording element substrate 1*a* (and of course of 1*b*, as well, although not shown) through the stud bumps 14. This electrical connection is performed by applying a certain load and ultrasonic vibration for a predetermined time while the electrode connection area is heated to 160° C.–200° C. so that intermetallic bonding occurs between contact surfaces of the gold bumps on the electrodes 7 and the electrode leads 13 which are provided on the flexible film member 11 and are plated with gold. While single point bonding is employed in this embodiment, any other connecting methods, such as gang bonding for connecting all of connection points at a time by using a thermally fusing unit, a reflow method of melting solder bumps, wire bonding for connecting pairs of corresponding electrodes by wires, and a known ACF (anisotropic conductive film) connecting method, are also usable. An optimum one may be selected from among those methods in consideration of the existing production line.

In the recording element unit, the flexible film member 11 is fixedly bonded to the support plate 9 such that the film member 11 completely covers the support plate 9 and juts on and extends beyond the outer peripheral edge of the support plate 9 by a predetermined amount so as to provide a pent roof-like shape. Therefore, by supplying a resin agent (third sealing resin) 27 from one point along an outer periphery of the flexible film member 11, the sealing resin 27 is caused to flow around the entire outer periphery of the flexible film member 11 due to capillary forces acting in a region bounded by the rear surface of the jutting portion of the flexible film member 11, an outer peripheral surface of the support plate 9, and the surface of the support member 8. The sealing resin 27 is preferably made of a material having a sufficiently low viscosity to allow the material to spread naturally to the entire outer periphery of the flexible film member 11 under the action of capillary forces once it is applied to a predetermined position in a predetermined amount. One optimum example of the material is a thermosetting silicone-modified epoxy resin (NR200C) produced by Japan Rec Co., Ltd. Using this epoxy resin reliably prevents the applied sealing resin from spreading out of the surface of the flexible film member 11.

Further, a first thermosetting sealing resin 18 is applied to fill and protect not only recesses 17 formed around the recording element substrates 1*a*, 1*b* within the opening of the flexible film member 11 and an opening of the support plate 9, but also parts (spaces around the stud bumps and below the electrode leads) of electrical connection areas between the plurality of recording element substrates 1*a*, 1*b* and the flexible film member 11. (The opening of the support plate 9 is shown as the gap between the two portions of the support plate 9 shown in FIGS. 1B and 1C.) The first thermosetting sealing resin 18 is preferably a thermosetting resin agent having elasticity even after being hardened, for example, a thermosetting silicone-modified epoxy resin (NR200C) produced by Japan Rec Co., Ltd. In this embodiment, the resin sealing step is simplified by using the same material for the first sealing resin 18 and the third sealing resin 27. Furthermore, grooves 28 are formed on the surface of the support member 8 in areas facing the recesses 17 so as to surround the recording element substrates 1*a*, 1*b*. The grooves 28 allow the first sealing resin 18 poured into the recesses 17 to easily flow and reach the entire circumference or perimeter of the recesses 17.

Moreover, the upper side (region straddling the flexible film member 11 to the ejection orifice plate 5 with the electrode leads 13 situated therebetween) of the electrical connection areas between the plurality of recording element substrates 1*a*, 1*b* and the flexible film member 11 is coated and protected by a second thermosetting sealing resin 19. The second thermosetting sealing resin 19 is preferably a thermosetting resin agent having a very high hardness and hence a high mechanical strength after being hardened, for example, a thermosetting epoxy resin (CV5420D) produced by Matsushita Electric Works, Ltd.

Those thermosetting sealing resins 18, 19 and 27 are cured for hardening at the same time, after being applied. In this embodiment, the thermosetting sealing resins 18, 19 and 27 are hardened at the same time by curing them at 100° C. for one hour and then at 150° C. for three hours. The curing conditions are determined in consideration of a degree of damage that a device employing the thermosetting sealing resins 18, 19 and 27 may suffer, from the heat applied for the hardening. By hardening the thermosetting sealing resins 18, 19 and 27 at the same time, production efficiency can be improved in comparison with curing those resins successively.

A second wiring board 16 is electrically connected to the flexible film member 11, and an external input pad 15 for applying an electrical signal, such as recording information, to the liquid jet recording head from the body side of a recording apparatus is provided on the second wiring board 16. of course, the flexible film member 11 and the second wiring board 16 may be constructed by one and the same board, thus having an integral structure. The flexible film member 11 is bent to extend along the recording liquid supply member (not shown in FIG. 1C) and bonded to it.

With the thus-constructed liquid jet recording head of this embodiment, since the first sealing resin 18 filled in the recesses 17, which are formed around the recording element substrates 1*a*, 1*b* within the opening of the flexible film member 11 and the opening of the support plate 9, has elasticity even after being hardened, there is no risk that the recording element substrates 1*a*, 1*b* may suffer from cracks or other damage upon a shrinkage of the first sealing resin 18 during the hardening. Further, since the electrical connection areas between the recording element substrates 1*a*, 1*b* and the flexible film member 11 are coated by the second sealing resin 19, those electrical connection areas can be protected against external forces imposed during, e.g., wiping of the head.

In addition, since the flexible film member 11 is formed so as to completely cover the upper surface of the support plate 9 and to extend beyond the outer peripheral edge of the support plate 9 in the form of a pent roof, the sealing resin 27 can be applied to the rear surface (side facing the support member 8) of the jutting portion of the flexible film member 11. It is therefore possible not only to prevent the sealing resin 27 from adhering to a heater (not shown) being used for the joining of the flexible film member 11 to the support plate 9 by thermal pressing, but also to prevent the sealing resin 27 from spreading out to the surface side of the flexible film member 11 and deteriorating printing quality due to contact of the spread-out sealing resin with a recording medium (not shown).

A method of manufacturing the above-described liquid jet recording head will be described below, with reference to FIGS. 1A–1C, primarily.

In the method of manufacturing the liquid jet recording head, the support plate 9 is first joined to a predetermined position on the support member 8 using a bonding resin B 22.

Then, the recording element substrates 1*a*, 1*b* are each inserted through the opening of the support plate 9 and joined to a predetermined position on the support member 8 using a bonding resin A 21. The flexible film member 11 is joined onto the support plate 9 using a bonding resin C 23 such that it completely covers the upper surface of the support plate 9 and extends beyond the outer peripheral edge of the support plate 9 in the form of a pent roof.

Subsequently, the electrode leads of the flexible film member 11 are electrically connected to the electrode pads of the recording element substrates 1*a*, 1*b* in a one-to-one relation.

Then, after filling the first sealing resin 18, which retains elasticity even after being hardened, into the recesses 17 formed around the recording element substrates 1*a*, 1*b* within the opening of the flexible film member 11 and the opening of the support plate 9 (see FIG. 1B), the electrical connection areas between the recording element substrates 1*a*, 1*b* and the flexible film member 11 are coated by the second sealing resin 19 (see FIG. 1C). Conversely, after coating the electrical connection areas between the recording element substrates 1*a*, 1*b* and the flexible film member 11 with the second sealing resin 19, the first sealing resin 18, which retains elasticity even after being hardened, may be filled into the recesses 17 formed around the recording element substrates 1*a*, 1*b* within the opening of the flexible film member 11 and the opening of the support plate 9. Also, filling of the first sealing resin 18 into the recesses 17 is preferably performed while heating the support member 8 to a predetermined temperature so that the first sealing resin 18 has a lower viscosity and more smoothly fills the recesses 17 with higher certainty.

Then, a third sealing resin 27 is supplied to only one point along the outer periphery of the flexible film member 11 so that the sealing resin 27 flows to the entire outer periphery of the flexible film member 11 based on capillary forces acting in the region surrounded by the rear surface (facing the support member 8) of a portion of the flexible film member 11, which extends beyond the outer peripheral edge of the support plate 9 in the form of a pent roof, the outer peripheral surface of the support plate 9, and the surface of the support member 8 facing the flexible film member 11. In this way, the third sealing resin 27 is applied to the entire outer periphery of the flexible film member 11.

Finally, the first sealing resin 18, the second sealing resin 19, and the third sealing resin 27 are cured at the same time, for hardening.

Constructions and correlations of a head cartridge, a recording head, and ink tanks, in which the present invention is suitably employed or applied, will be described below with reference to the drawings.

Figure 2:
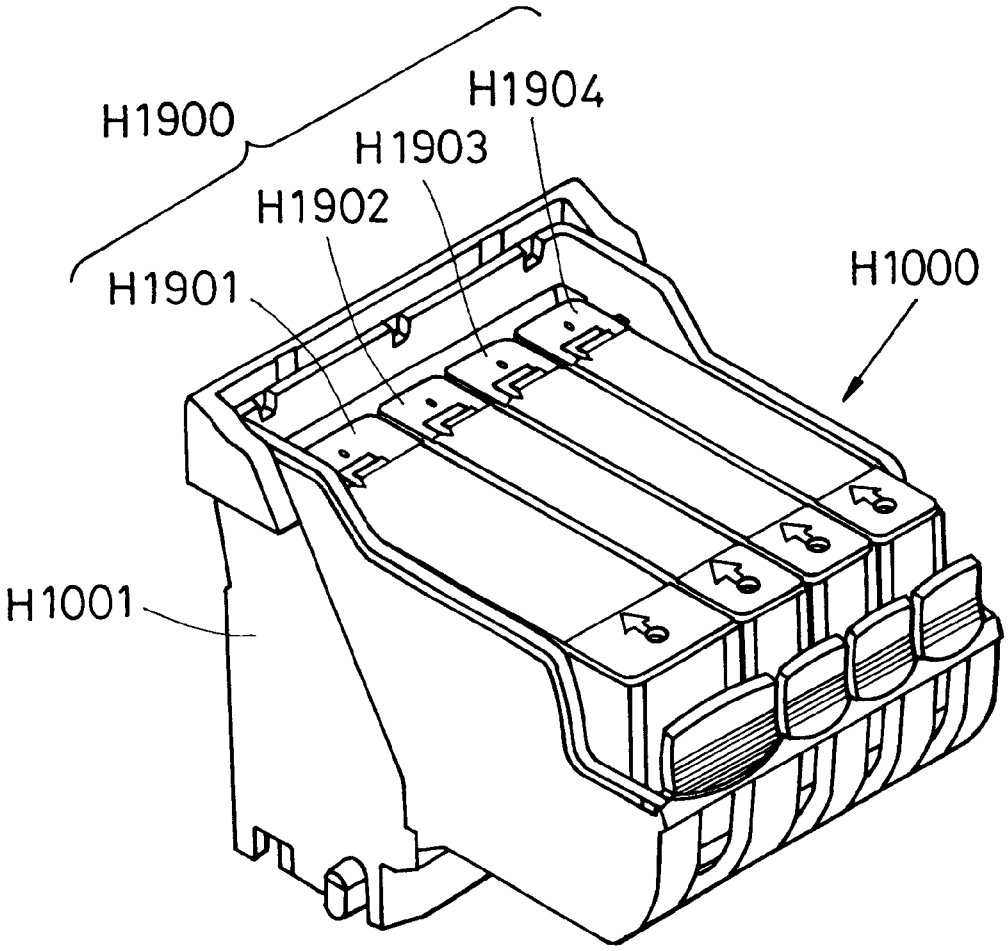
FIG. 2 is a perspective view showing one embodiment of a recording head cartridge of the present invention in a state where a recording head and ink tanks are combined with each other.
Figure 3:
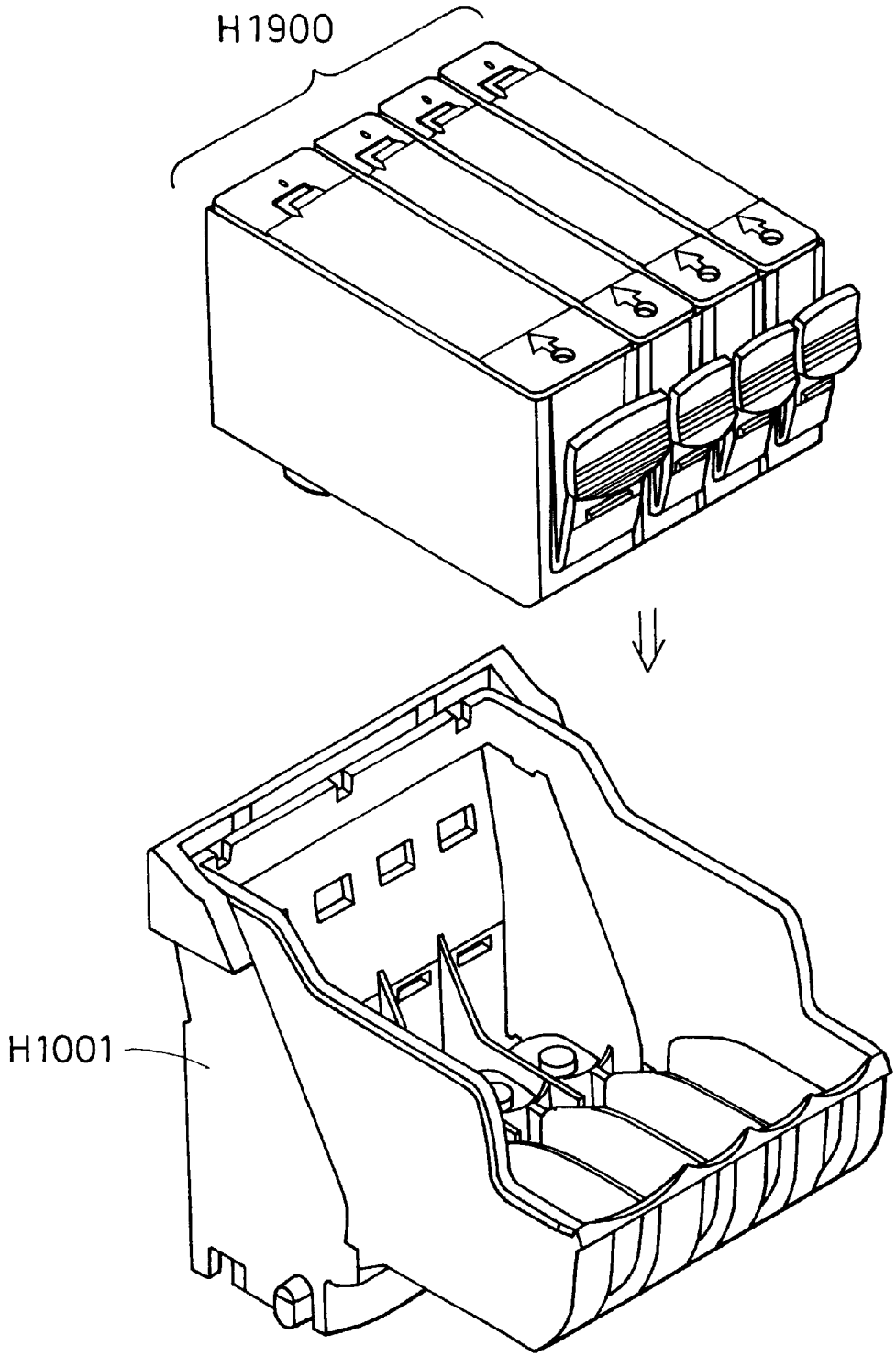
FIG. 3 is a perspective view showing one embodiment of the recording head cartridge of the present invention in a state where the recording head and the ink tanks are separated from each other.

FIGS. 2 and 3 are perspective views showing one embodiment of a recording head cartridge of the present invention. Specifically, FIG. 2 shows a state where a recording head and ink tanks are combined with each other, and FIG. 3 shows a state where the recording head and the ink tanks are separated from each other.

As will be seen from FIGS. 2 and 3, a recording head H1001 of this embodiment is one component of a recording head cartridge H1000. The recording head cartridge H1000 comprises the recording head H1001 and ink tanks H1900 (H1901, H1902, H1903 and H1904) detachably attached to the recording head H1001. The recording head cartridge H1000 is fixedly supported by a positioning arrangement and electrical contacts, which are provided on a carriage (not shown) mounted to a body of an ink jet recording apparatus, such that the cartridge H1000 is detachable from the carriage. The ink tank H1901 contains black ink; the ink tank H1902 contains cyan ink; the ink tank H1903 contains magenta ink; and the ink tank H1904 contains yellow ink. These ink tanks H1901, H1902, H1903 and H1904 are detachably attached to the recording head H1001, allowing each ink tank to be replaced with a new one. Accordingly, an ink tank in which the amount of remaining ink has become small, can be replaced separately, and hence the running cost of image recording in the ink jet recording apparatus can be reduced.

The overall construction and individual components of the recording head H1001 will be described below in detail.

1 Recording Head

The recording head H1001 is a bubble jet recording head of the side shooter type wherein recording is carried out using electrothermal transducers for generating thermal energy sufficient to cause film boiling of ink in accordance with an applied electrical signal.

Figure 4:
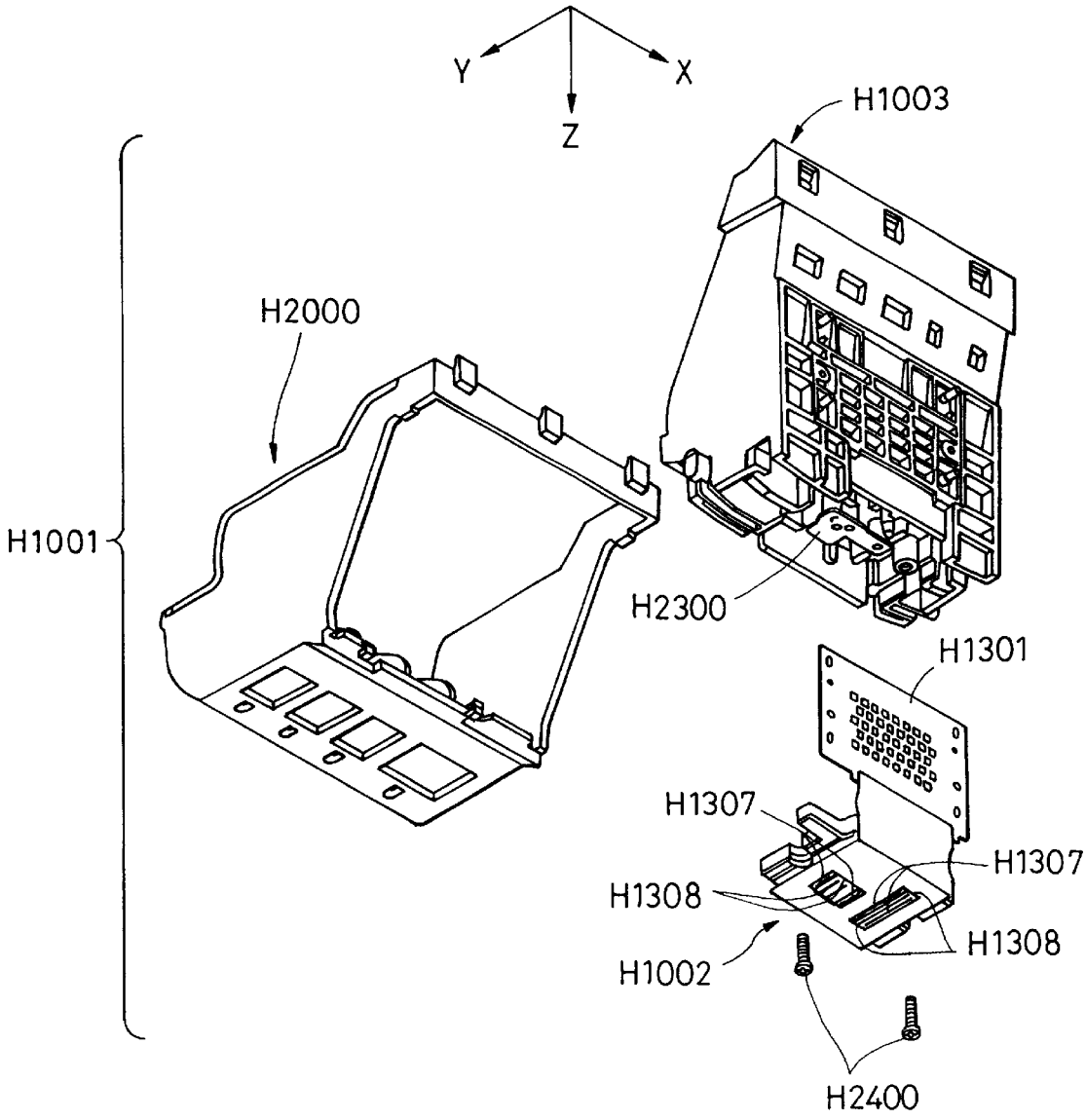
FIG. 4 is an exploded perspective view of the recording head cartridge shown in FIG. 2, etc.

As shown in an exploded perspective view of FIG. 4, the recording head H1001 comprises a recording element unit H1002, an ink supply unit H1003, and a tank holder H2000.

Figure 5:
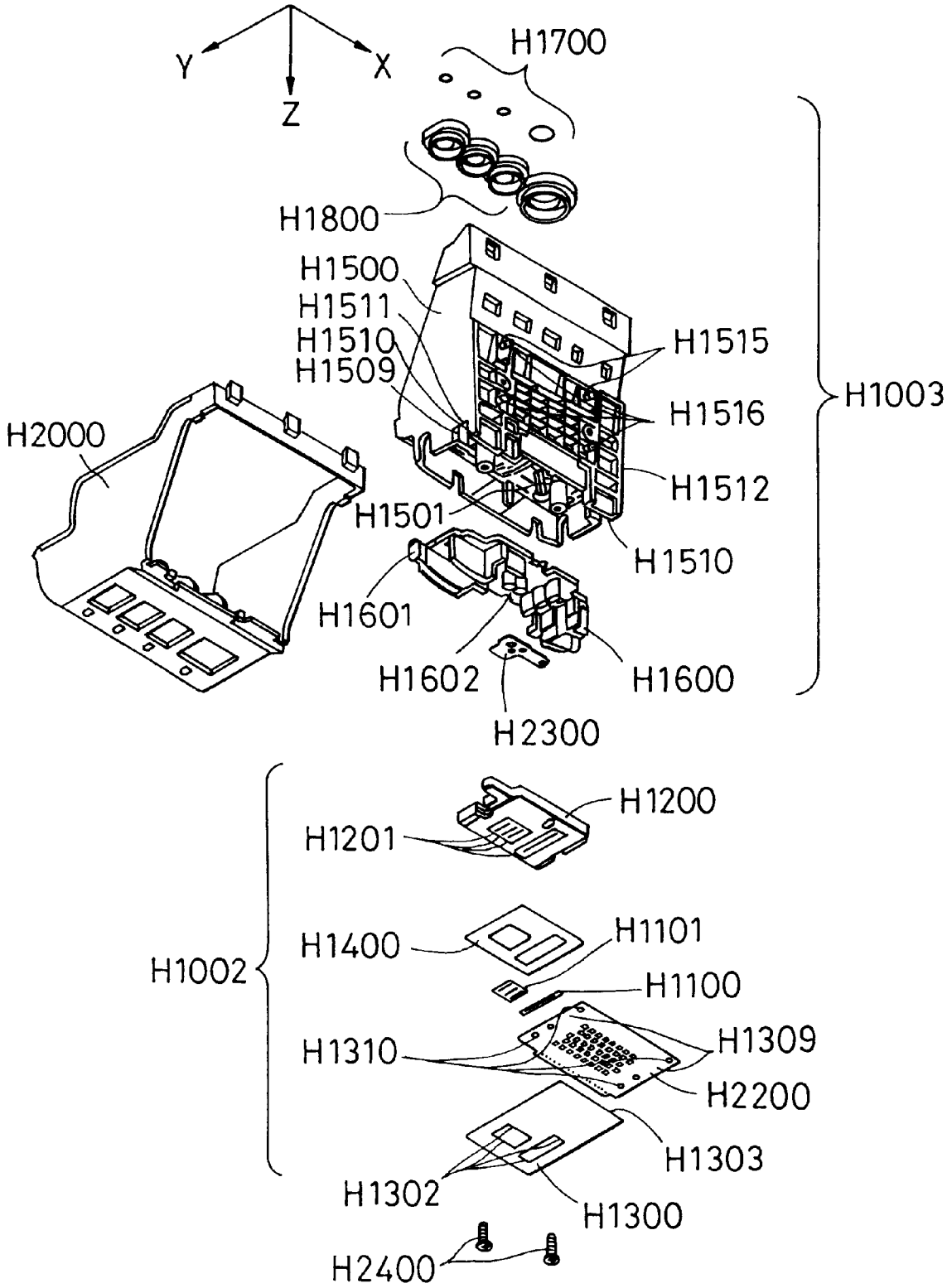
FIG. 5 is an exploded perspective view of an ink supply unit and the recording element unit shown in FIG. 4.

Further, as shown in an exploded perspective view of FIG. 5, the recording element unit H1002 comprises a first recording element substrate H1100, a second recording element substrate H1101, a first plate H1200, an electrical wiring tape H1300, an electrical contact board H2200, and a second plate H1400. The ink supply unit H1003 comprises an ink supply member H1500, a flow passage forming member H1600, a joint rubber H2300, filters H1700, and sealing rubbers H1800.

(1) Recording Element Unit

Figure 6:
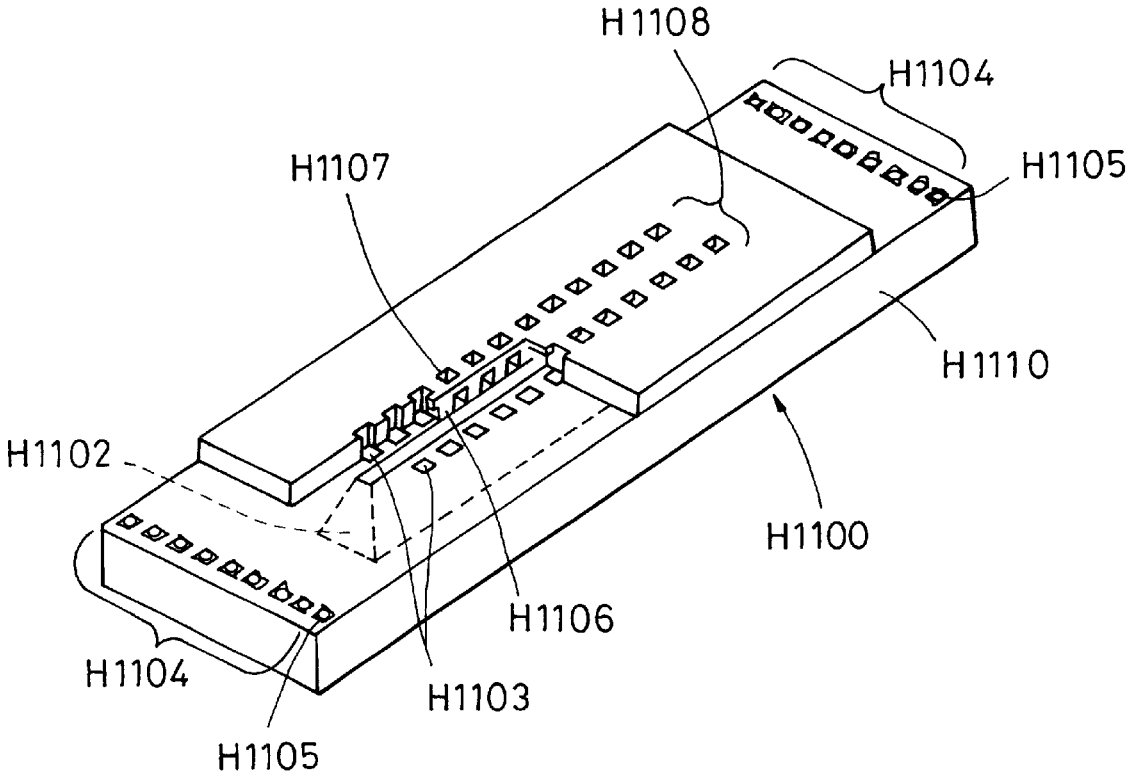
FIG. 6 is a perspective view, partly broken, of a first recording element substrate shown in FIG. 1, etc.

FIG. 6 is a perspective view, partly broken, of the it first recording element substrate H1100.

The first recording element substrate H1100 is constituted, for example, by a Si substrate H1110 having a thickness of 0.5 to 1 mm, in which an ink supply port H1102 is formed as an ink flow passage in the shape of long groove-like through hole by anisotropic etching or sand blasting, for example, utilizing the Si crystal orientation. Electrothermal transducers H1103 are arranged on both sides of the ink supply port H1102 in the form of a zigzag row for each side. The electrothermal transducers H1103 and electrical wires made of, e.g., Al for supplying power to the electrothermal transducers H1103 are formed by the film forming technique. Further, electrodes H1104 for supplying power to the electrical wires are arranged outward of both ends of the rows of electrothermal transducers H1103, and bumps H1105 made of, e.g., Au, are formed on the electrodes H1104. On the Si substrate H1110, ink flow passage walls H1106 and ejection orifices H1107 are formed by photolithography using a resin material to form ink flow passages corresponding to the electrothermal transducers H1103, thereby forming an ejection orifice group H1108. Thus, since the ejection orifices are provided opposite to the electrothermal transducers H1103, ink supplied through the ink supply port H1102 is ejected upon bubbles being generated by the electrothermal transducers H1103.

Figure 7:
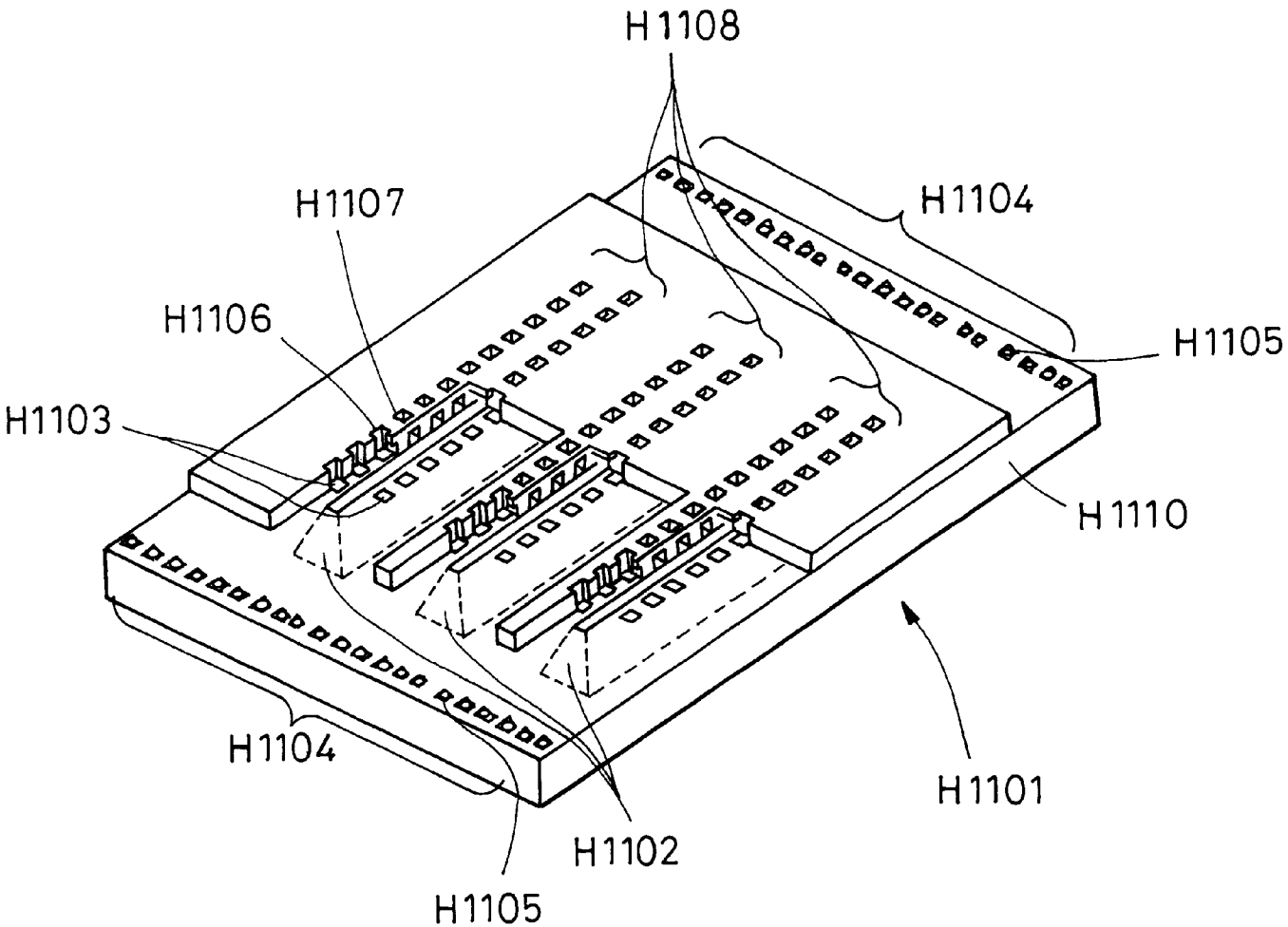
FIG. 7 is a perspective view, partly broken, of a second recording element substrate shown in FIG. 1, etc.

FIG. 7 is a perspective view, partly broken, of the second recording element substrate H1101.

The second recording element substrate H1101 is a recording element substrate for ejecting inks of three colors, and includes three ink supply ports H1102 arranged in parallel. Electrothermal transducers and ink ejection ports are formed on both sides of each ink supply port. As with the first recording element substrate H1100, the ink supply ports, the electrothermal transducers, electrical wires, electrodes, etc., are formed in and on a Si substrate. Also, ink flow passage walls and ink ejection orifices are formed on the Si substrate by photolithography, using a resin material. Further, as with the first recording element substrate H1100, bumps H1105 made of, e.g., Au, are formed on the electrodes H1104 for supplying power to the electrical wires.

Referring to FIG. 5 again, the first plate H1200 is made of, for example, an alumina ($Al_2O_3$) material having a thickness of 0.5 to 10 mm. Materials of the first plate H1200 are not limited to alumina, but may be one having a coefficient of linear expansion comparable to, and a coefficient of thermal conductivity comparable to or higher than, that of the material of the recording element substrate H1100. More specifically, the first plate H1200 may be made of any material selected from among, e.g., silicon (Si), aluminum nitride (AlN), zirconia, silicon nitride ($Si_3N_4$), silicon carbide (SiC), molybdenum (Mo), and tungsten (W).

In the first plate H1200, there are formed one ink supply port H1201 for supplying black ink to the first recording element substrate H1100 and three other ink supply ports H1201 for supplying cyan, magenta and yellow inks to the second recording element substrates H1101. The ink supply ports H1102 of the first and second recording element substrates correspond respectively to the ink supply ports H1201 of the first plate H1200. The first recording element substrate H1100 and the second recording element substrate H1101 are fixedly bonded to the first plate H1200 with high positional accuracy. A first adhesive used for bonding the first and second recording element substrates to the first plate H1200 is preferably one having a low viscosity and a low hardening temperature, being able to harden in a short time, having a relatively high hardness after being hardened, and having resistance against the inks. A preferable example of the first adhesive is a thermosetting adhesive containing an epoxy resin as a main ingredient, and a thickness of an adhesive layer is preferably not more than 50 $\mu$m.

The electrical wiring tape H1300 is a flexible wiring member on which are formed wires for applying electrical signals for ejection of the inks to the first recording element substrate H1100 and the second recording element substrate H1101. The electrical wiring tape H1300 includes a plurality of openings in which the recording element substrates are assembled, electrode terminals H1302 corresponding respectively to the electrodes H1104 of the recording element substrates, and an electrode terminal portion H1303 positioned at an end of the electrical wiring tape H1300 for connection to the electrical contact board H2200 having external signal input terminals to receive electrical signals from the apparatus body. The electrode terminals H1302 and the electrode terminal portion H1303 are connected to each other by continuous wiring patterns formed of copper foils.

The electrical wiring tape H1300, the first recording element substrate H1100, and the second recording element substrate H1101 are electrically connected to each other. The electrical connection between those components is performed, for example, by joining the electrodes H1104 of the recording element substrates and the electrode terminals H1302 of the electrical wiring tape H1300 together by ultrasonic thermal pressing for electrical conduction between them.

The second plate H1400 is formed of, for example, one piece of plate-like member having a thickness of 0.5 to 1 mm, and is made of, for example, any of ceramics such as alumina ($Al_2O_3$) and metallic materials such as Al and SUS (stainless steel). The second plate H1400 has openings greater than the outer dimensions of the first recording element substrate H1100 and the second recording element substrate H1101 that are fixedly bonded to the first plate H1200. In order that the first recording element substrate H1100 and the second recording element substrate H1101 can be electrically connected to the electrical wiring tape H1300 in a planar relation, the second plate H1400 is bonded to the first plate H1200 by a second adhesive, and a rear surface of the electrical wiring tape H1300 is fixedly bonded to the second plate H1400 by a third adhesive.

Electrical connection areas between the first and second recording element substrates H1100, H1101 and the electrical wiring tape H1300 are sealed by the first sealing resin 18 and the second sealing resin 19, as shown in FIG. 1C, whereby the electrical connection areas are protected against corrosion caused by the inks and externally applied impacts. The first sealing resin 18 primarily seals not only the rear side of joined portions between the electrode terminals H1302 of the electrical wiring tape H1300 and the electrodes 1104 of the recording element substrates, but also outer peripheral portions of the recording element substrates. The second sealing resin 19 seals the front side of those joined portions. In FIG. 1C, the electrode leads 13 are positioned at the boundary between the first sealing resin 18 and the second sealing resin 19. For example, however, when the amount of first sealing resin 18 is small, the boundary between both the sealing resins lowers to a position below the electrode leads 13.

To the end of the electrical wiring tape H1300, the electrical contact board H2200 having the external signal input terminals to receive electrical signals from the apparatus body is electrically connected by thermal pressing using, e.g., an anisotropic conductive film.

Additionally, the electrical wiring tape H1300 is bent at one side of the first plate H1200 and is bonded to a lateral surface of the first plate H1200 by the third adhesive. The first adhesive is, e.g., a thermosetting adhesive containing an epoxy resin as a main ingredient, which is applied in thickness of 10 to 100 $\mu$m.

(2) Ink Supply Unit

The ink supply member H1500 shown in FIG. 5 is formed, for example, by resin molding. A resin material for the ink supply member H1500 is preferably mixed with 5 to 40% of glass fillers for improving rigidity in shape.

Figure 8:
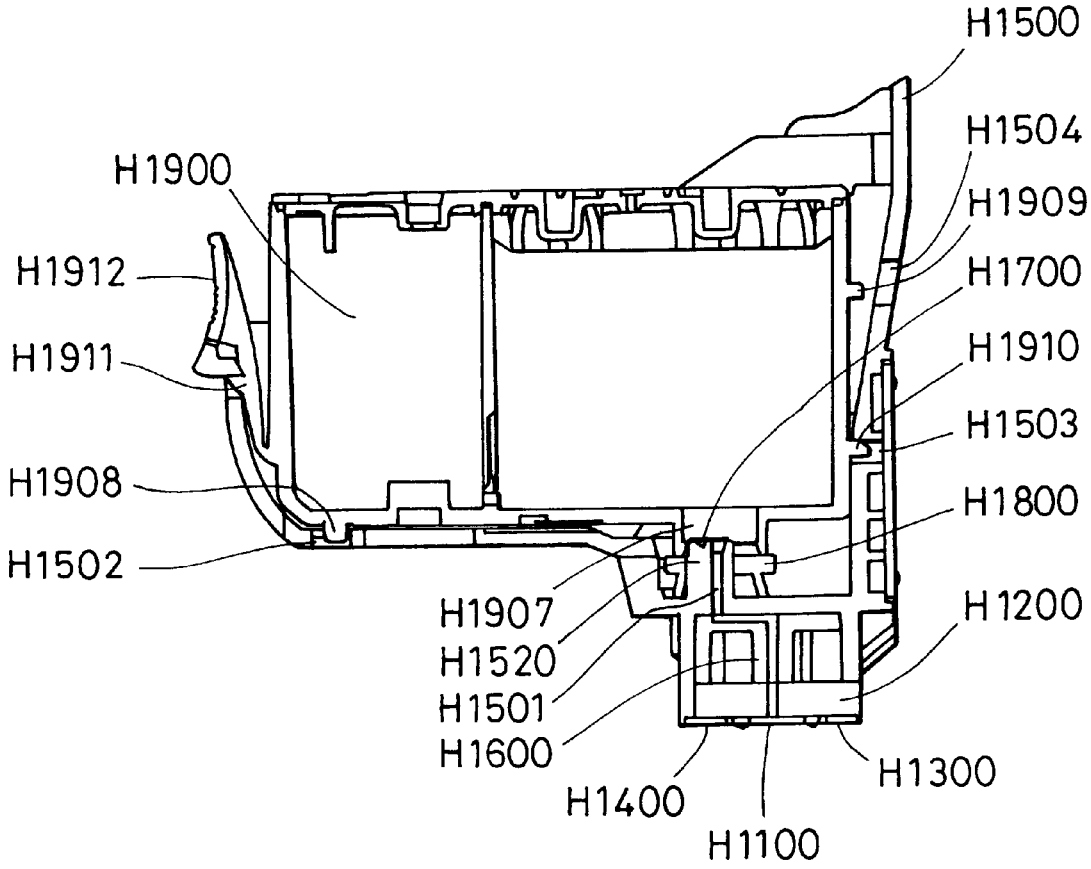
FIG. 8 is a sectional view of the recording head cartridge shown in FIG. 2, etc.

As shown in FIGS. 5 and 8, the ink supply member H1500 is one component of the ink supply unit H1003 for introducing the inks from the ink tanks H1900 to the recording element unit H1002. The flow passage forming member H1600 for forming an ink flow passage H1501 is fixed to the ink supply member H1500 by ultrasonic fusing. Also, filters H1700 for preventing intrusion of dust from the outside are joined by fusing to respective joint portions H1520 with which the ink tanks H1900 are engaged. Further, the sealing rubbers H1800 are fitted to the joint portions H1520 to prevent the inks from evaporating through the joint portions H1520.

The ink supply member H1500 also fulfills a part of the function of holding the ink tanks H1900 that are detachably attached in place. To this end, the ink supply member H1500 includes a first hole H1503 in which a second pawl H1910 provided on each ink tank H1900 is engaged.

Moreover, the ink supply member H1500 includes a mount guide H1601 for guiding the recording head cartridge H1000 to a mount position in the carriage of the ink jet recording apparatus body; an engagement portion used for fixedly mounting the recording head cartridge H1000 to the carriage by a head setting lever; and an abutment portion H1509 in the X-direction (direction of carriage scan), an abutment portion H1510 in the Y-direction (feed direction of a recording medium), and an abutment portion H1511 in the Z-direction (direction of ink ejection), these abutment portions serving to position the recording head cartridge H1000 on the carriage at the predetermined mount position. In addition, the ink supply member H1500 includes a terminal fixing portion H1512 for fixing the electrical contact board H2200 of the recording element unit H1002 while positioning it in place. A plurality of ribs are provided on the terminal fixing portion H1512 and the periphery thereof to increase rigidity of a surface in which the terminal fixing portion H1512 is provided.

(3) Joining between Recording Head Unit and Ink Supply Unit

As shown in FIG. 4, the recording head H1001 is completed by joining the recording element unit H1002 to the ink supply unit H1003, and then joining a resulting assembly to the tank holder H2000. This joining step is performed as follows.

The recording element unit H1002 and the ink supply unit H1003 are fixed by screws H2400 in a pressure contact state with a joint rubber H2300 situated therebetween such that the ink supply port of the recording element unit H1002 (the ink supply port H1201 of the first plate H1200) and the ink supply port of the ink supply unit H1003 (the ink supply port H1601 of the flow passage forming member H1600) are communicated with each other without causing a leak. At the same time, the recording element unit H1002 is fixed after being precisely positioned with respect to the reference points on the ink supply unit H1003 in the X-, Y- and Z-directions.

Figure 9:
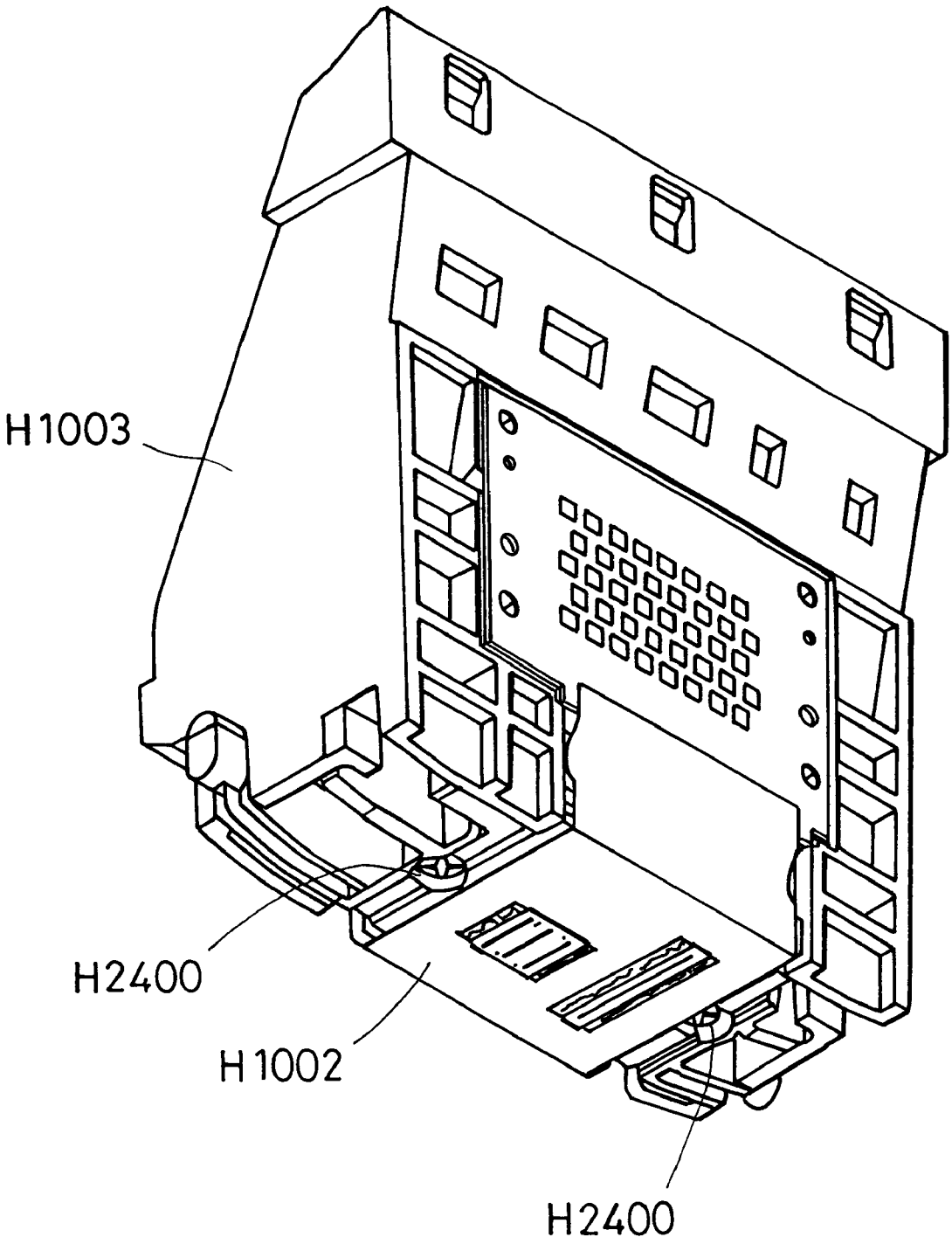
FIG. 9 is a perspective view showing a jointed body of the recording element unit and the ink supply unit in the recording head cartridge shown in FIG. 2, etc.

Then, the electrical contact board H2200 of the recording element unit H1002 is fixed to one lateral surface of the ink supply member H1500 while it is precisely positioned with the aid of terminal positioning pins H1515 (two locations) and terminal positioning holes H1309 (two locations). This fixing is performed, for example, by caulking the terminal positioning pins H1515 provided on the ink supply member H1500 in this embodiment, but may be performed using any other suitable fixing means. As a result, a joined integral assembly of the recording element unit H1002 and the ink supply unit H1003 is constructed as shown in FIG. 9.

Figure 10:
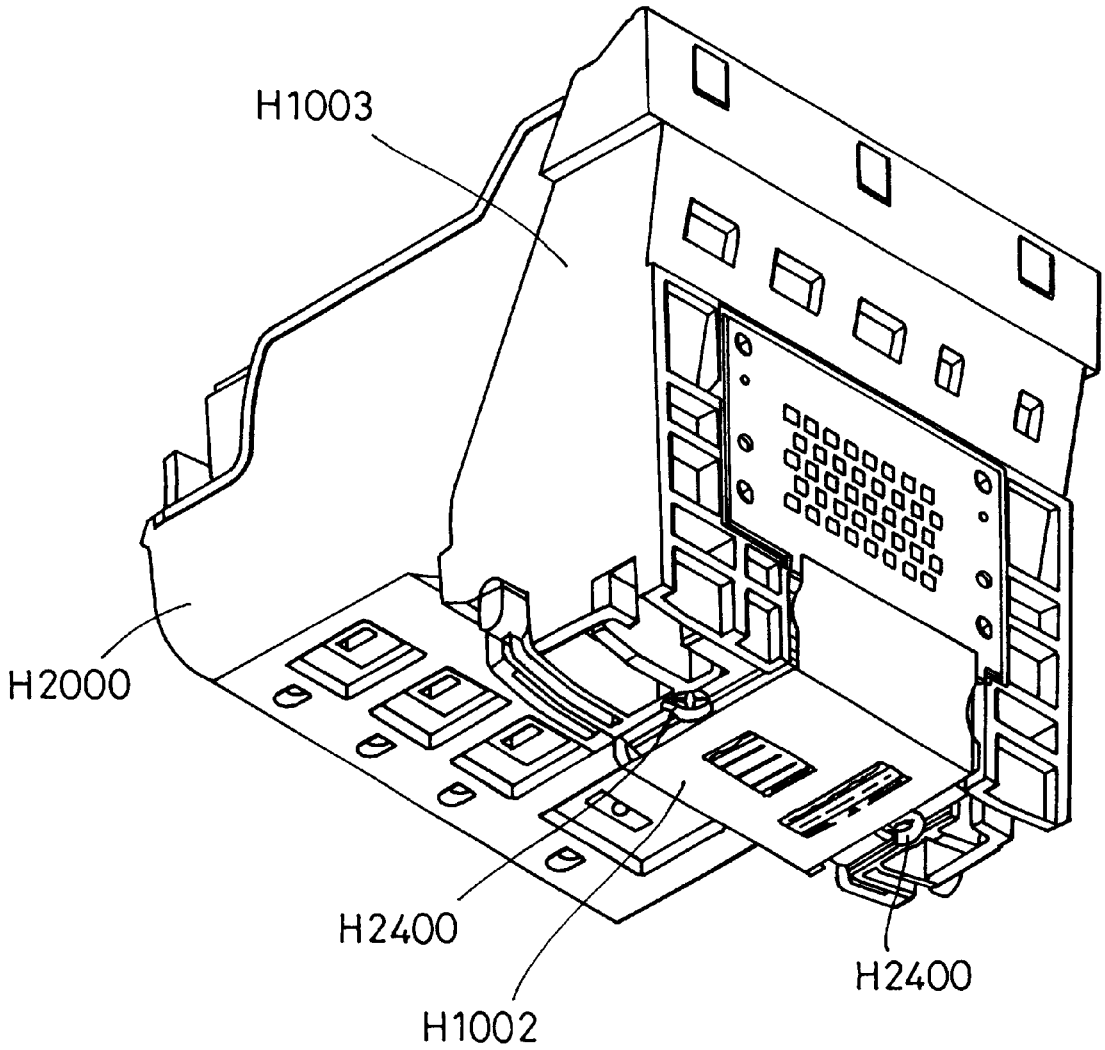
FIG. 10 is a perspective view showing a bottom surface of the recording head cartridge shown in FIG. 2, etc.
Figure 11A:
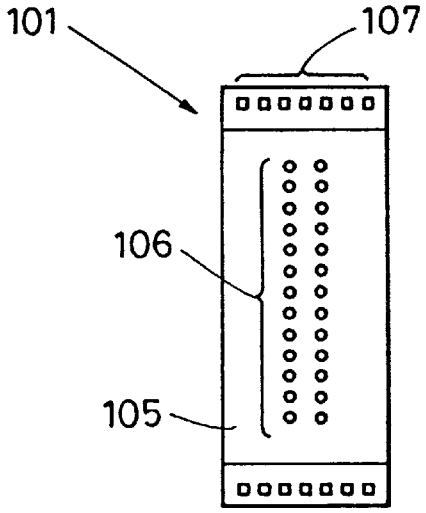
FIG. 11A PRIOR ART
FIGS. 11A, 11B and 11C show a conventional typical recording element substrate on which electrothermal transducers are arranged and which has the function of ejecting a recording liquid.
Figure 11B:
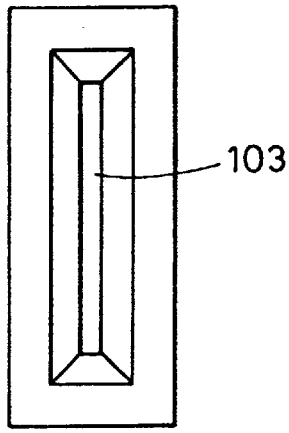
FIG. 11B PRIOR ART
Figure 11C:
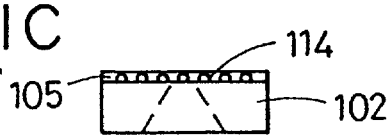
FIG. 11C PRIOR ART
Figure 12:
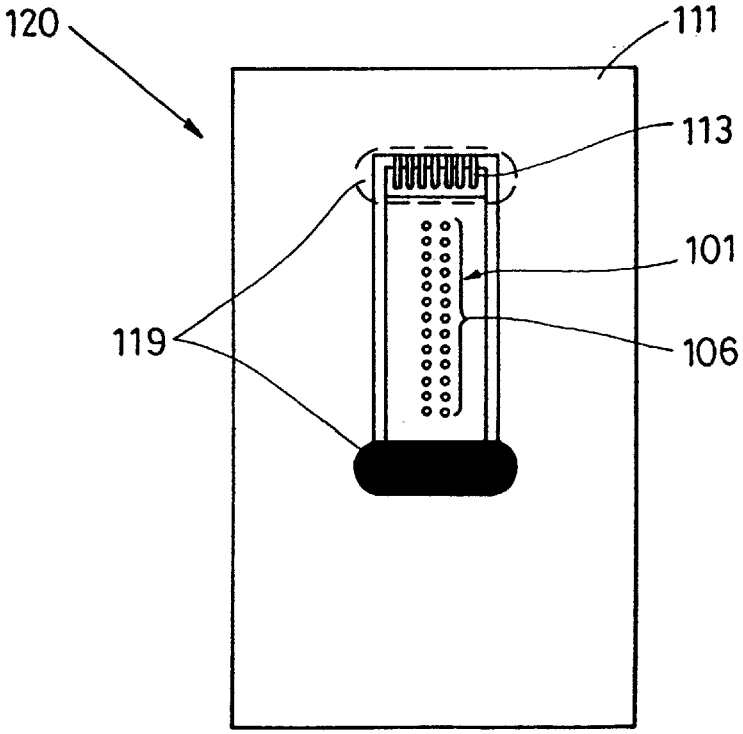
FIG. 12 PRIOR ART
FIG. 12 shows the recording element substrate of FIG. 11 in a state connected to a wiring board.
Figure 13:
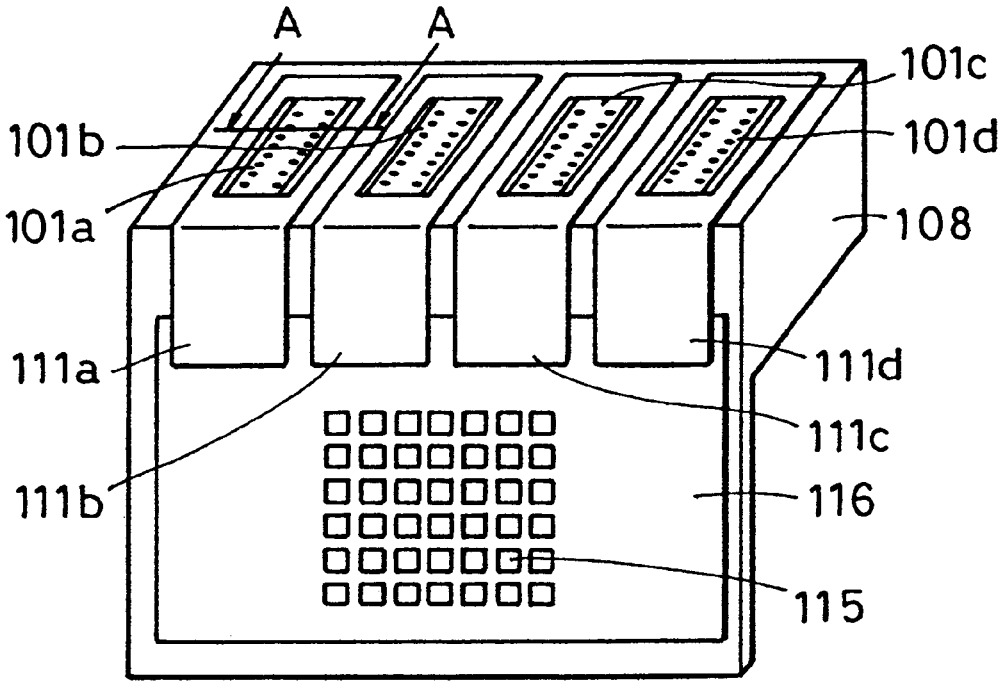
FIG. 13 PRIOR ART
FIG. 13 is an external appearance perspective view showing one structural example of a conventional liquid jet recording head in which the recording element unit of FIG. 12 is incorporated.
Figure 14:
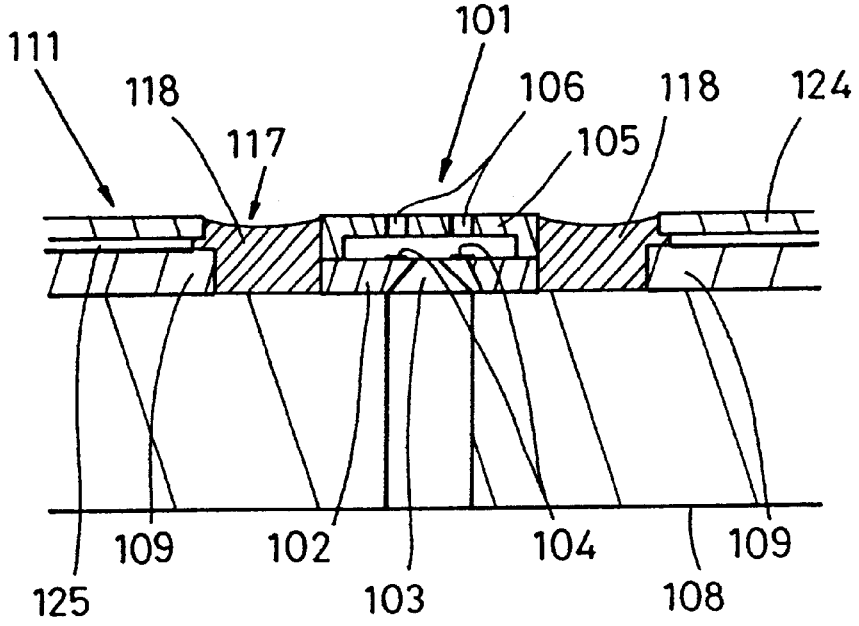
FIG. 14 PRIOR ART
FIG. 14 is a sectional view of the liquid jet recording head taken along line A—A in FIG. 13.
Figure 15:
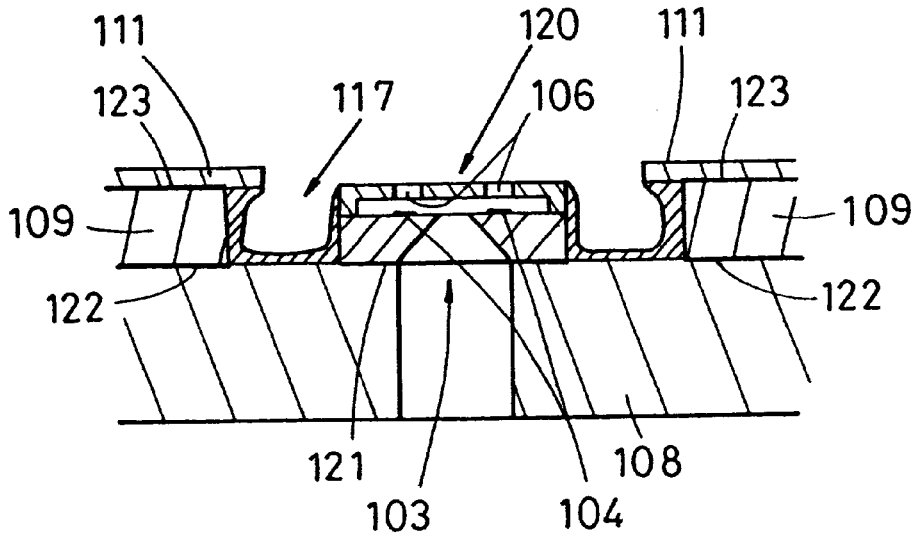
FIG. 15 PRIOR ART
FIG. 15 is a sectional view showing a structural example of another liquid jet recording head.

Further, the recording head H1001, shown in FIG. 10, is completed by fitting and joining the tank holder H2000 to the ink supply member H1500 through holes and projections provided on the ink supply member H1500 for joining to the tank holder H2000.

2 Recording Head Cartridge

FIGS. 2 and 3 show the operation for mounting the ink tanks H1901, H1902, H1903 and H1904 to the recording head H1001 as one component of the recording head cartridge H1000. The ink tanks H1901, H1902, H1903 and H1904 contain the inks of the four colors mentioned above. Also, as shown in FIG. 8, each ink tank H1900 is formed with an ink supply port H1907 for supplying the ink in each ink tank to the recording head H1001. For example, when the ink tank H1901 is mounted to the recording head H1001, the ink supply port H1907 of the ink tank H1901 is brought into pressure contact with the filter H1700 provided in the joint portion H1520 of the recording head H1001, and the black ink in the ink tank H1901 is supplied to the first recording element substrate H1100 from the ink supply port H1907 through the ink flow passage H1501 of the recording head H1001 and then the first plate H1200.

Subsequently, the ink is supplied to a bubbling chamber in which the electrothermal transducers H1103 and the ejection orifices H1107 are disposed. The ink is then ejected toward a recording medium, e.g., a sheet of recording paper, with thermal energy applied from the electrothermal transducers H1103, whereby an image is recorded on the sheet of recording paper.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid jet recording head comprising:

at least one recording element unit comprising a recording element substrate including a plurality of recording elements for ejecting a recording liquid, and a flexible film member having an opening in which said recording element substrate is assembled, and electrically connected to said recording element substrate for applying electrical energy to said recording element substrate for ejection of the recording liquid, said flexible film member including a plurality of electrode leads which are provided along edges of the opening of said flexible film member and are electrically connected to a plurality of electrode pads provided along edges of said recording element substrate;

a support member on which said recording element substrate is fixedly held; and a support plate having an opening into which said recording element substrate is inserted, situated between said flexible film member of said recording element unit and said support member, and fixedly holding said flexible film member, wherein a first thermosetting resin agent, which retains elasticity even after being hardened, is filled into recesses formed around said recording element substrate within the opening of said flexible film member and the opening of said support plate, and electrical connection areas between said recording element substrate and said flexible film member are coated by a second thermosetting resin agent, which has a higher mechanical strength after being hardened than said first resin agent.

2. A liquid jet recording head according to claim 1, wherein said first resin agent is a thermosetting silicone-modified epoxy resin.

3. A liquid jet recording head according to claim 1, wherein said second resin agent is a thermosetting epoxy resin.

4. A liquid jet recording bead according to claim 1, wherein said flexible film member is hired so as to completely cover an upper surface of said support plate and to extend beyond an miter peripheral edge of said support plate.

5. A liquid jet recording head according to claim 1, wherein an outer periphery of said flexible film member is sealed by a sealing agent.

6. A liquid jet recording head according to claim 5, wherein said flexible film member is formed so as to completely cover an upper surface of said support plate and to extend beyond an outer peripheral edge of said support plate, and said sealing agent is applied along a surface of a portion of said flexible film member which juts beyond the outer peripheral edge of said support plate, said surface facing said support member, and along an outer peripheral surface of said support plate.

7. A liquid jet recording head according to claim 5, wherein said first resin agent and said sealing agent are made of a same material.

8. A liquid jet recording head according to claim 7, wherein said first resin agent and said sealing agent are made of a thermosetting silicone-modified epoxy resin.

9. A method of manufacturing a liquid jet recording head comprising at least one recording element unit comprising a recording element substrate including a plurality of recording elements for ejecting a recording liquid, and a flexible film member having an opening in which the recording element substrate is assembled, and electrically connected to the recording element substrate for applying electrical energy to the recording element substrate for ejection of the recording liquid, the flexible film member including a plurality of electrode leads which are provided along edges of the opening of the flexible film member and are electrically connected to a plurality of electrode pads provided along edges of the recording element substrate;

a support member on which the recording element substrate is fixedly held; and a support plate having an opening into which the recording element substrate is inserted, situated between the flexible film member of the recording element unit and the support member and fixedly holding the flexible film member, wherein a first thermosetting resin agent, which retains elasticity even after being hardened, is filled into recesses formed around the recording element substrate within the opening of the flexible film member and the opening of the support plate, and electrical connection areas between the recording element substrate and the flexible film member are coated by a second thermosetting resin agent, which has a higher mechanical strength after being hardened than the first resin agent, said method comprising the steps of:

joining the support plate to a predetermined position on the support member joining the recording element substrate of the recording element unit to a predetermined position on the support member through the opening of the support plate, and joining the flexible film member onto the support plate;

electrically connecting the plurality of electrode leads of the flexible film member respectively to the plurality of electrode pads of the recording element substrate;

filling the first resin agent into the recesses;

coating the electrical connection areas with the second resin agent; and heating the first resin agent and the second resin agent after said filling step and said coating step.

10. A method of manufacturing a liquid jet recording head according to claim 9, wherein the electrical connection areas are coated by the second resin agent after said filling step.

11. A method of manufacturing a liquid jet recording head according to claim 9, wherein the first resin agent is filled into the recesses after said coating step.

12. A method of manufacturing a liquid jet recording head according to claim 9, wherein said electrically connecting step is performed by gang bonding for connecting all connection points at a same time.

13. A method of manufacturing a liquid jet recording head according to claim 9, wherein said electrically connecting step is performed by single-point bonding for connecting connection points one by one, successively.

14. A method of manufacturing a liquid jet recording head according to claim 9, wherein said electrically connecting step is performed by wire bonding for connecting connection points one by one, successively.

15. A method of manufacturing a liquid jet recording head according to claim 9, wherein said electrically connecting step is performed by an ACF connecting method.

16. A method of manufacturing a liquid jet recording head according to claim 9, wherein the flexible film member in the liquid jet recording head is formed so as to completely cover an upper surface of the support plate and to extend beyond an outer peripheral edge of the support plate.

17. A method of manufacturing a liquid jet recording head according to claim 9, further comprising the stop of applying a sealing agent to an outer periphery of the flexible film member.

18. A method of manufacturing a liquid jet recording head according to claim 17, wherein the flexible film member in the liquid jet recording head is formed so as to completely cover an upper surface of the support plate and to extend beyond an outer peripheral edge of the support plate, and said applying step further comprises the step of supplying the sealing agent to only one point of the outer periphery of the flexible film member so that the sealing agent flows to the entire outer periphery of the flexible film member due to capillary forces acting in a region surrounded by a jutting portion of the flexible film member, a surface of the flexible film facing the support member, an outer peripheral surface of the support plate, and a surface of the support member facing the flexible film member.

19. A method of manufacturing a liquid jet recording head according to claim 17, wherein the sealing agent is a thermosetting resin, and further comprising the step of heating the sealing agent, the first resin agent and the second resin agent after said filling step, said coating step and said applying step.

20. A liquid jet recording head comprising:

a recording element substrate including a plurality of recording elements for ejecting a recording liquid;

a flexible film member electrically connected to said recording element substrate for applying electrical energy to said recording elements for the ejection of the recording liquid, said flexible film member including a plurality of electrical leads which are provided along an edge of said recording element substrate and are electrically connected to a plurality of electrodes provided on said recording element substrate along said edge of said recording element substrate;

a support plate on which said flexible film member is held; and a support member on which said recording element substrate and said support plate are held, wherein a gap is formed between said recording element substrate and said support plate, said gap is closed by a first resin composed of an elastic resin, and an electrical connection area between said recording element substrate and said flexible film member in which said electrical leads are connected to said electrodes is covered with a second resin having a higher mechanical strength than said first resin.

21. A liquid jet recording head comprising:

a recording element substrate including a plurality of recording, elements for ejecting a recording liquid;

a wiring board electrically connected to said recording element substrate for applying electrical energy to said recording elements for the ejection of the recording liquid, said wiring board including a plurality of electrical leads which are provided along an edge of said recording element substrate and are electrically connected to a plurality of electrodes provided on said recording element substrate along said edge of said recording element substrate;

a support plate on which said wiring board is held; and a support member on which said recording element substrate and said support plate are held, wherein a gap is formed between said recording element substrate and said support plate, said gap is closed by a first resin composed of an elastic resin, and an electrical connection area between said recording element substrate and said wiring board in which said electrical leads are connected to said electrodes is covered with a second resin having a higher mechanical strength than said first resin.

* * * * *

UNITED STATES PATENT AND TRADEMARK OFFICE

CERTIFICATE OF CORRECTION

PATENT NO. : 6,609,782 B2
DATED : August 26, 2003
INVENTOR(S) : Toshihiro Mori

It is certified that error appears in the above-identified patent and that said Letters Patent is hereby corrected as shown below:

Column 10,
Line 59, “of” should read -- Of --.

Column 12,
Line 66, “the it,” should read -- the --.

Column 17,
Line 21, “hired” should read -- formed --; and
Line 23, “miter” should read -- outer --.

Column 18,
Line 8, “member” should read -- member; --; and
Line 49, “stop” should read -- step --.

Column 20,
Line 5, “recording,” should read -- recording --.

Signed and Sealed this

Twenty-ninth Day of June, 2004

JON W. DUDAS
*Acting Director of the United States Patent and Trademark Office*